United States Patent [19]

Kandler

[11] Patent Number: 4,579,092

[45] Date of Patent: Apr. 1, 1986

[54] CRANKCASE BREATHER MECHANISM

[75] Inventor: William C. Kandler, New Holstein, Wis.

[73] Assignee: Tecumseh Products Company, Tecumseh, Mich.

[21] Appl. No.: 680,060

[22] Filed: Dec. 10, 1984

Related U.S. Application Data

[62] Division of Ser. No. 423,800, Sep. 27, 1982, Pat. No. 4,507,917, which is a division of Ser. No. 188,135, Sep. 17, 1980, Pat. No. 4,380,216.

[51] Int. Cl.[4] ..... F01M 13/00

[52] U.S. Cl. ..... 123/41.86; 123/196 CP; 55/441

[58] Field of Search ..... 123/41.86, 196 CP, 572, 123/574; 55/DIG. 19, 441, 420

[56] References Cited

U.S. PATENT DOCUMENTS

| | | | |
|---|---|---|---|
| 1,761,944 | 9/1927 | Taylor | 123/41.86 |
| 2,056,755 | 9/1934 | Welch, Jr. | 123/41.86 |
| 2,500,859 | 3/1950 | Pates | 123/41.86 |
| 2,782,775 | 5/1954 | Leach | 123/41.86 |
| 2,818,052 | 12/1957 | Trainer | 123/41.86 |
| 2,821,174 | 1/1958 | Scheiterlein | 123/41.86 |
| 2,849,994 | 5/1956 | Barker | 123/41.86 |
| 3,087,474 | 10/1961 | Catha | 123/41.86 |
| 3,140,794 | 6/1962 | Arndt et al. | 220/303 |
| 3,271,938 | 5/1963 | Rest et al. | 123/41.86 |
| 3,363,616 | 9/1965 | Baumgarten | 123/41.86 |
| 3,494,111 | 6/1967 | Hathaway | 123/41.86 |
| 3,550,567 | 12/1970 | Crow | 123/41.86 |
| 3,765,386 | 10/1973 | Ottofy | 123/41.86 |
| 3,875,916 | 4/1975 | Patton | 123/41.86 |
| 3,978,671 | 9/1976 | Gonzalez | 123/41.86 |
| 4,169,432 | 10/1979 | White | 123/41.86 |

FOREIGN PATENT DOCUMENTS

| | | | |
|---|---|---|---|
| 662516 | 9/1949 | United Kingdom . | |
| 1255642 | 12/1971 | United Kingdom | 123/41.86 |
| 436167 | 11/1974 | U.S.S.R. | 123/41.86 |

*Primary Examiner*—Craig R. Feinberg
*Assistant Examiner*—David A. Okonsky
*Attorney, Agent, or Firm*—Albert L. Jeffers; Anthony Niewyk

[57] ABSTRACT

An improved engine construction is disclosed having a valve train including valves and corresponding valve stems for controlling the intake and exhaust ports, cams for imparting reciprocating motion to the valves by way of the valve train, and a valve spring for biasing each valve toward its closed position and the valve train into tracking relation with the cam. The only element of the valve train coupling a cam to a stem is a cam follower with a depression for receiving the corresponding stem end and a cam engaging surface opposite the depression with the cam follower being held captive intermediate the stem and cam solely by the spring biasing of the stem toward the cam and the engagement of the stem end and the depression. A feature of the engine resides in a combination crankcase breather mechanism and oil fill cap which due to its remote location from the engine crankshaft as well as the tortuous air flow path through the cap to the atmosphere minimizes the egress of oil from the engine through the breather mechanism.

8 Claims, 12 Drawing Figures

CRANKCASE BREATHER MECHANISM

This is a division of application Ser. No. 423,800, filed Sept. 27, 1982, now U.S. Pat. No. 4,507,917, which is a division of application Ser. No. 188,135, filed Sept. 17, 1980, now U.S. Pat. No. 4,380,216.

BACKGROUND OF THE INVENTION

The present invention relates generally to small internal combustion engines of the type which might for example be employed in snowthrowers, lawnmowers and the like techniques.

Engines of this general type are frequently vertical crankshaft four-stroke cycle engines provided with a powered take-off shaft for example to drive the wheels of a self-propelled lawnmower having but a single cylinder, a solid state ignition arrangement and a pull rope recoil starter. Such engines have been well known for a number of years and have met with considerable commercial success and while the present invention will be described in the context of such an engine, the invention is clearly applicable to other engine designs.

SUMMARY OF THE INVENTION

Among the several objects of the present invention may be noted the provision of an internal combustion engine having:

a combined crankcase breather and oil filler cap which effectively separates engine oil from exiting gases due in part to its remoteness from the engine crankcase, and in part to the circuitous air escape path through the cap; the provision of a combined crankcase breather and oil filler cap with an oil collecting tray in a tortuous air venting path having an oil drain hole in the bottom thereof; and the provision of an internal combustion engine characterized by its simplicity of construction and economy of manufacture. These as well as other objects and advantageous features of the present invention will be in part apparent and in part pointed out hereinafter.

In general, and in one form of the invention, a crankcase breather and oil fill cap has a cap portion for engaging the oil filler opening on an internal combustion engine along with upper and lower baffle portions providing interleaved baffles defining an oil catching tray having an oil drain for allowing oil accumulated in the tray to drain back into the engine crankcase. The breather mechanism may include a check valve and preferably is located remote from the engine crankcase to reduce the oil content of gases reaching the oil filler opening.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
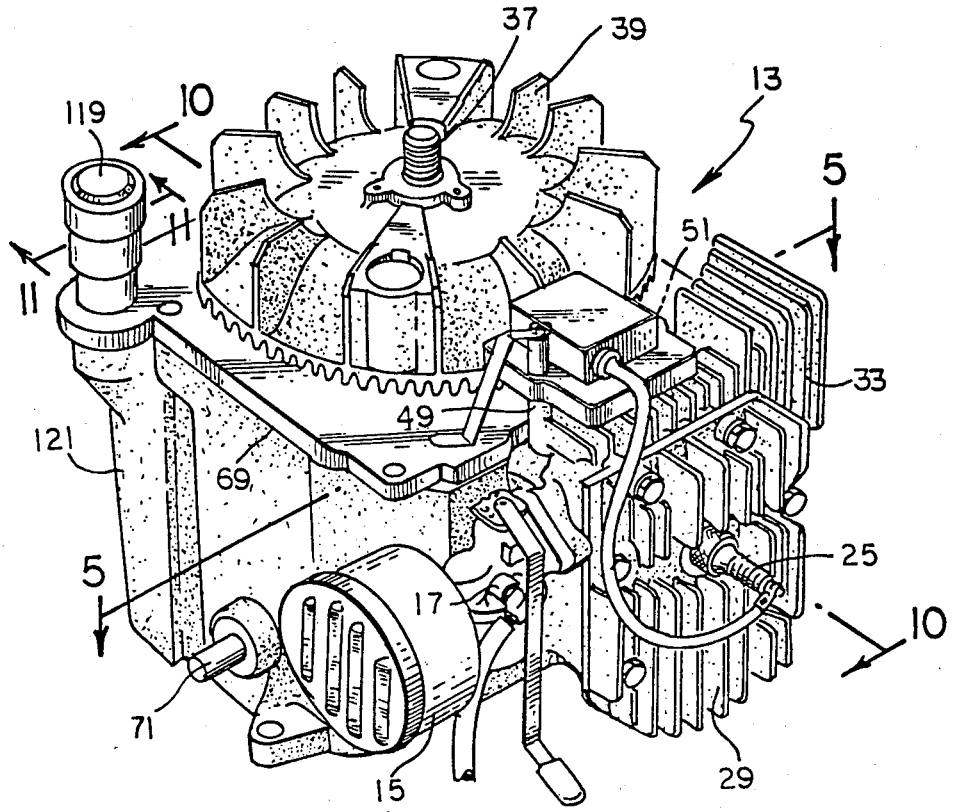
FIG. 1 is a perspective view of a low cost internal combustion engine incorporating present invention.

Referring first to some of the broadly conventional features of the internal combustion engine 13 of FIG. 1, in operation air is ingested through air cleaner 15 to be mixed with fuel in carburetor 17, and that fuel air mixture passing through an intake conduit past the open intake valve 21 of the poppet or lift variety (FIG. 5) and into cylinder 23 (FIG. 4) to be compressed and ignited by a spark from sparkplug 25, initiating the expansion or power stroke of the piston. Thereafter, valve 21 remains closed and exhaust valve 27 (FIG. 5) opens and as the piston progresses toward cylinder head 29, the exhaust gases are expelled from the cylinder by way of exhaust port 31 (FIG. 5) and the exhaust muffler 33 to the atmosphere.

Figure 10:
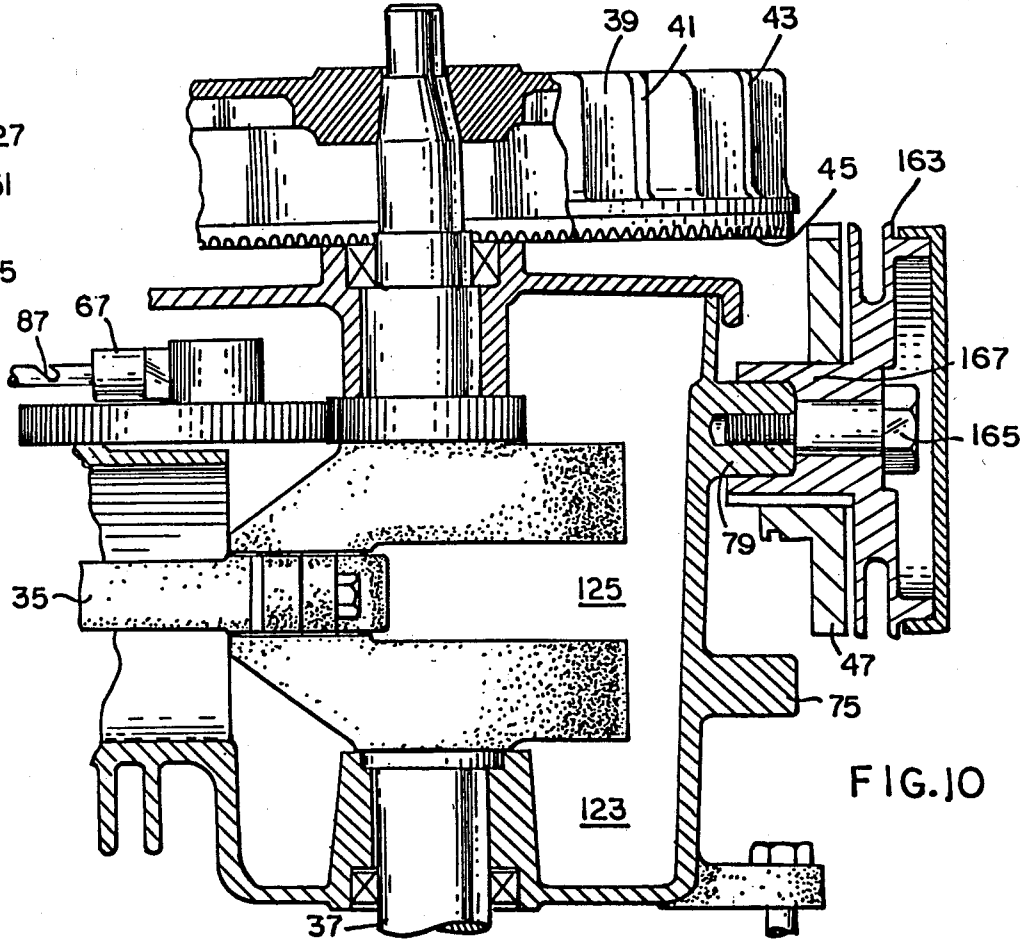
FIG. 10 is a view in cross-section along the line 10—10 of FIGS. 1 and 5 illustrating the engine crankshaft and recoil start mechanism.

Referring briefly to FIG. 10, the engine piston is connected by a conventional connecting rod 35 to crankshaft 37, the lower end of which may connect to a mower blade in known fashion. The upper end of crankshaft 37 is connected to a flywheel 39 which may have a plurality of vanes 41 and 43 for circulating air within an engine housing, not shown, for the purposes of illustration, as well as a toothed gear portion 45 for cooperating with teeth on a spur gear 47, selectively actuable by a pull rope to engage the teeth 45 to start the engine, and additionally may include a permanent magnet or other portion of an ignition system for the engine. Flywheel 39, as such, may be of the type disclosed in copending U.S. application Ser. No. 923,997, filed July 12, 1978, and assigned to the assignee of the present application, while the engine ignition system is not illustrated, but may be of the type illustrated in either U.S. Pat. Nos. 3,490,426 or 3,952,712, as well as any of several other known ignition systems with the bosses 49 and 51 of FIG. 1 being provided to mount that ignition system.

Turning now to some of the non-conventional features of the present invention, and referring still to the drawing generally, it should first be noted that a number of the engine parts are manufactured as cast plastic parts while their prior art counterparts, if they exist at all, are manufactured of metal and have the earlier mentioned subsequent expensive machining operation required. Thus, in FIGS. 5, 6, 8 and 9, the radial cams 51 and 53 are the spur drive gears 55 and 57, along with spur gear 59, power take-off bevel gears 61 and 63, and the pair of cam followers or shoes 65 and 67 may all be manufactured from a plastic material, however, in many cases some of these elements, such as spur gear 59, may be of a powdered metal or other type material. In one embodiment of the present invention, the cams and spur drive gears and bevel gear 63 were injection molded of Dupont's ZYTEL 70G-33HS1-L while the lifters 65 were injection molded of Dupont's DELRIN 100 NC-10.

Another difference in the design philosophy of the present engine, as compared to known prior art engines, resides in the casting of the engine block with a number of auxiliary elements integrally cast therewith and this integral casting feature is facilitated somewhat by locating the parting plane 69 substantially higher than on prior engines. Typically, the parting plane for the block casting on prior engines is located close to the power take-off shaft 71. Thus, the spring locating stud 73, a lug 75 for anchoring one end of the pull rope recoil starter spring, a pull rope guide 77, the boss 79 for mounting the pull rope recoil starter, and the previously mentioned exhaust muffler shell 33 may all be cast as an integral part of the engine block rather than fabricating each of these devices as a separate part which must be fastened to the block, requiring additional labor and increased costs.

Figure 4:
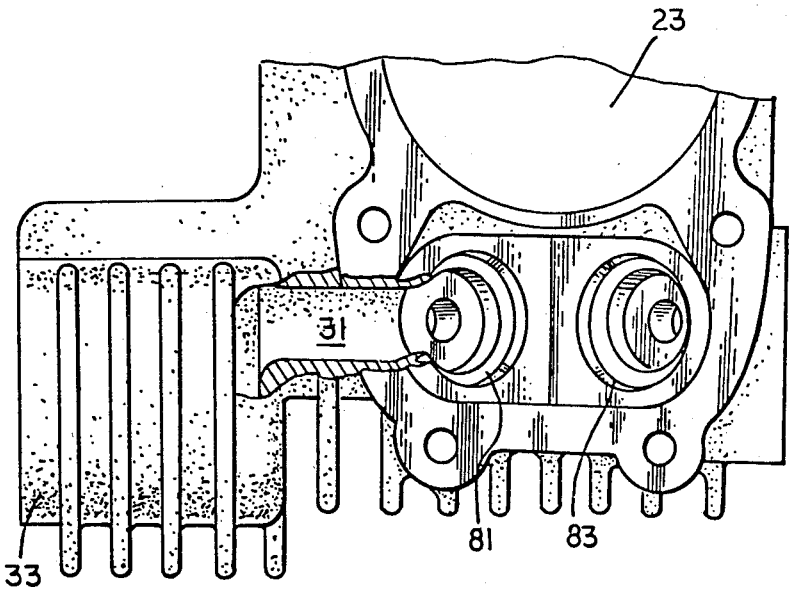
FIG. 4 is a view partially in section and at a right angle to the view of FIG. 2 illustrating a portion of the engine block casting including the intake and exhaust valve seat and the integrally cast muffler shell.
Figure 5:
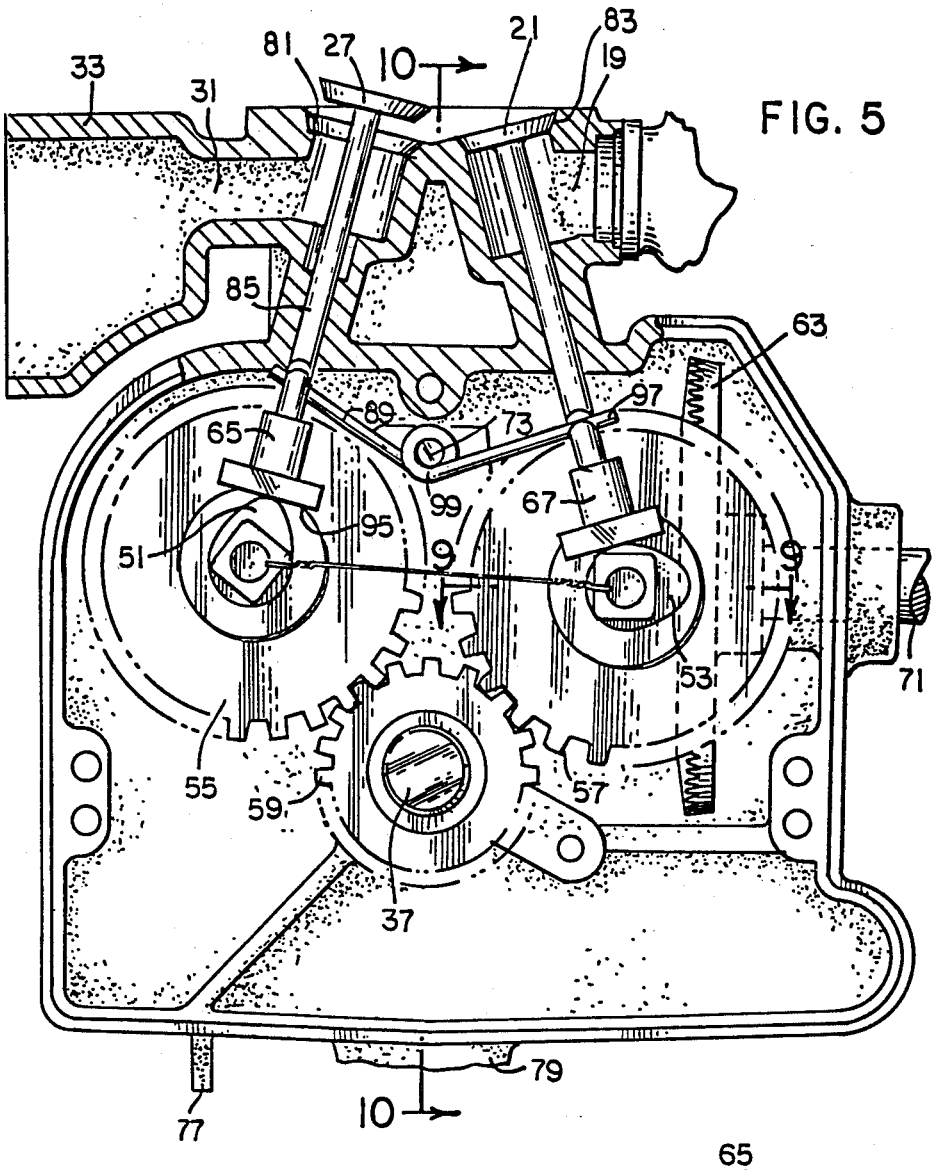
FIG. 5 is a view in section along the line 5—5 of FIG. 1 illustrating the engine valve train.
Figure 6A:
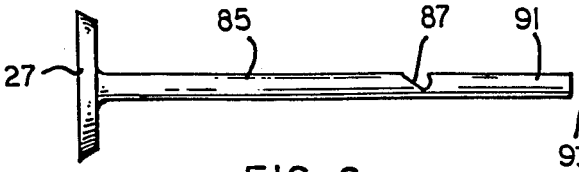
FIGS. 6*a* and 6*b* illustrate the valve stem and cam follower of FIG. 5 with the section of the follower in FIG. 6*a* being along the lines 6—6 of FIG. 6*b;*
Figure 6B:
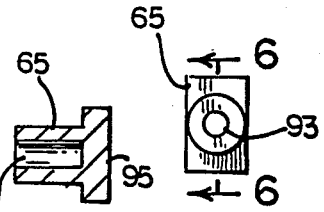

Delving more deeply into the unique aspects of the present engine, and referring first to FIG. *6a*, the valve portion 27 may be of any conventional poppet or lift valve configuration, typically having a tapered seat portion for mating with a similarly tapered seat portion 81 of the engine exhaust port of FIGS. 4 and 5. The intake port will have a similar tapered seat portion 83 for mating with the intake valve. Stem portion 85 is provided with a notch 87 for engagement with the leg 89 of the spring, and leg 97 engages a similar notch in the intake valve stem so that the spring biases both valves toward their closed position. Stem end 91 which is the end of the stem opposite the valve 27 fits snugly within the depression 93 of the cam follower or shoe 65 and of course the surface 95 opposite this depression in the shoe is the surface which rides on the surface of radial cam 51. It will be noted that when notch 87 is engaged by the spring leg 89, rotation of the valve about the stem axis will be prevented.

The exhaust valve and cam follower of FIGS. *6a* and *6b* are illustrated in position within the engine in FIG. 5 along with a very similar intake valve 21 and cam follower or shoe 67. Both valves are biased toward their closed position by the legs 89 and 97 of the coiled wire spring engaging their respective stem notches with the bight or helical portion 99 of this spring being held in a relatively fixed location by the stud or boss 73. It would, of course, also be possible to form a pocket in the engine block casting for holding this bight portion in position. Thus, each valve stem notch provides a fixed support for one spring leg when the other valve opens, flexing the spring. That this support location be fixed is of course not necessary, however, since intake and exhaust valves are typically not open at the same time, the support location is fixed relative to the other valve when that other valve opens. It should also be noted that no valve lifter guides are employed in the present engine and that the cam followers 65 and 67 are held in position solely by the valve stem engagement with the depression in the follower and the spring urging of the stem toward the cam so that the cam follower is captive between the cam and valve stem.

Still referring to FIG. 5, it will be noted that the gears 55 and 57 have a like number of teeth with this number being twice the number of teeth on spur gear 59 so that for each rotation of the spur gear 59, each of the gears 55 and 57 executes one-half revolution. The gear 59 is directly driven by the engine crankshaft 37 thereby providing the desired opening and closing of each of the intake and exhaust valves once during two revolutions of the engine.

Figure 9:
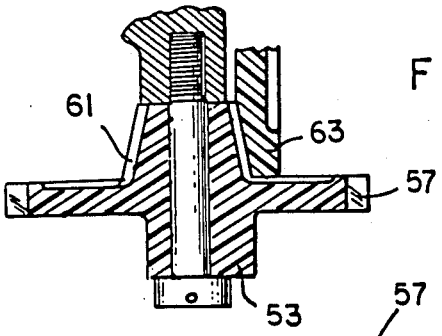
FIG. 9 is a sectional view along the line 9—9 of FIG. 8.
Figure 8:
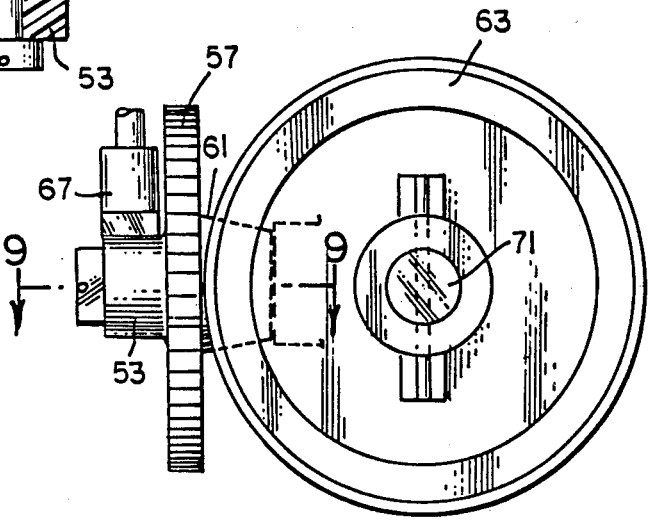
FIG. 8 is a view of the auxiliary power take-off arrangement and a portion of the valve train as seen from the right of FIG. 5.

A bevel gear 63 engages a substantially smaller bevel gear 61 on the rear side of spur gear 57, as best seen in FIGS. 8 and 9, with this substantial disparity in bevel gear sizes, and the two:one speed reduction between gears 59 and 57 providing the desired low speed rotation of the power takeoff shaft 71, as for example will be desired to drive the wheels of a power lawnmower. Gear 55 may be identical to gear 57 including the bevel gear portion like 61, if the reduction in initial tooling costs as well as the reduction in required spare parts inventory justifies this duplication, or gear 55 may be of a more simplistic design, since it need only drive cam 51. Of course also, somewhat different engine configurations may allow cams 51 and 53 to share a common shaft.

FIGS. 2, 3, 4 and 5 illustrate the integrally cast muffler shell of the present invention. As perhaps best seen in FIGS. 2, 4 and 5, an exhaust gas passageway 31 extends from the engine cylinder 23 by way of the exhaust port between valve 27 and seat 81 passing into a substantially enlarged area or cavity as defined by the shell 33 which forms at least a part of the muffler shell. Within the cavity and terminating near the open end, there is located a boss 101 also cast as an integral portion of the engine block and having an outwardly facing hole 103 which may be tapped or which may simply be a cast hole for receiving a self-tapping or self-threading screw 105. In either case, the boss provides a support for the muffler baffles 107 and 109.

Figure 3:
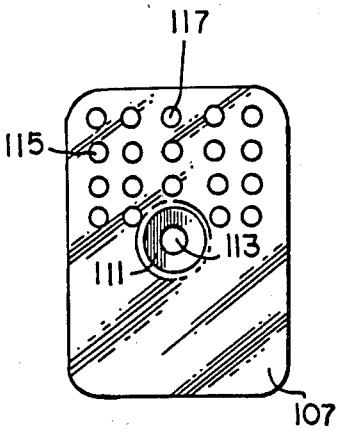
FIG. 3 is a view in elevation of one of the like pair of apertured metal baffle plates which occupy the open end of the muffler shell-defining cavity of FIG. 2.
Figure 2:
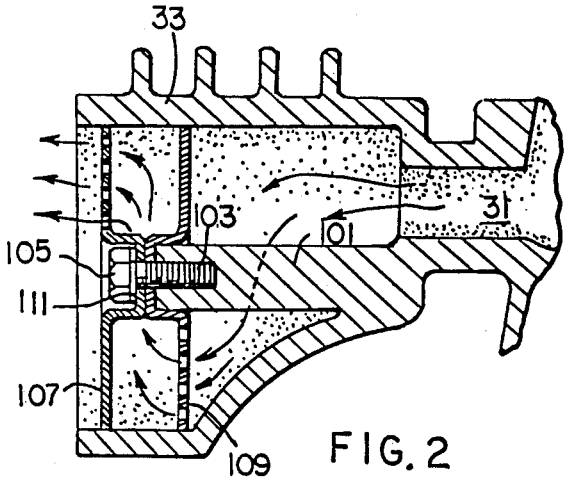
FIG. 2 is a cross-sectional view of a portion of the block of the engine of FIG. 1 showing the formation of the muffler shell therein.

As best illustrated in FIGS. 2 and 3, each baffle comprises an apertured metal plate for providing a circuitous or tortuous exhaust path from the cavity to the atmosphere. In FIG. 2, as illustrated by the arrows, this path from exhaust passageway 31, is through the apertures near the bottom of plate 101, then upwardly between the two plates and outwardly through the apertures in the upper portion of plate 107. The plates may be substantially identical, each having a generally centrally located depression 111 with the attachment bolt passing aperture 113 within the depression. The plates are positioned with their respective depressions abutting and the remaining plate portions separated by about twice the depth of the depressions and with bolt 105 passing through the respective apertures such as 113 and into boss 101 to securely hold the plates in position near the cavity open end.

As most clearly shown in FIG. 3, each plate is of a generally rectangular configuration provided with a plurality of small exhaust gas apertures, such as 115 and 117, with those small apertures being concentrated in one half of the rectangular configuration while the other half thereof is substantially aperture free. When the plates are then positioned with depression against depression, the apertured half of plate 107 is near the top, as illustrated in FIG. 2, while the apertured half of plate 109 is near the bottom of that same Figure.

The combination crankcase breather mechanism and oil fill cap 119 of FIG. 1 functions to restrict an oil filler opening in the engine which communicates by way of an oil fill tube generally at 121 and leading to the engine oil sump 123 (FIG. 10) while providing a flow path for the expulsion of gases from the engine crankcase 125 (FIG. 10) and limiting the egress of oil from the engine through that flow path. This breather mechanism cap combination is illustrated in cross-section in FIG. 11 and includes a screw cap portion 127, an upper baffle portion 129, and a lower baffle portion 131, all fastened together to provide a circuitous path, as illustrated by the arrows, from the crankcase to the atmosphere, by way of the disc 133 of a check valve and an oil collecting tray 135 having oil return drain holes, such as 137, near the bottom thereof.

Figure 11:
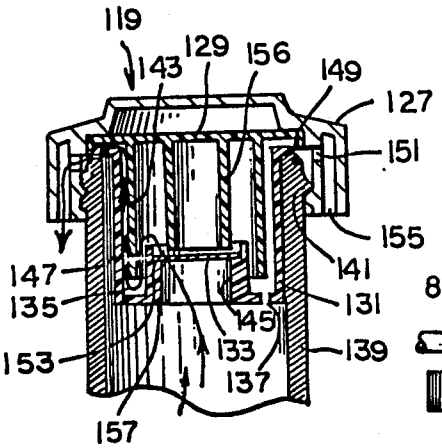
FIG. 11 is a view in section along line 11—11 of FIG. 1 illustrating the combined crankcase breather and filler cap.

Referring to FIG. 11 in greater detail, the oil fill opening may have a neck 139 with a threaded region 141 which engages a complementary portion of the screw cap 127 about the oil fill opening. The upper baffle portion 129 has a downwardly depending generally cyclindrical baffle 143 while the lower baffle portion 131 has inner 145 and outer 147 generally cylindrical baffles which are interleaved with the downwardly depending baffle 143. The disc 133 of the check valve is captive with a limited amount of free movement between the upper and lower baffle portions. This check valve restricts the entrance of air into the engine crankcase by way of the breather mechanism while allowing the expulsion of gases from the engine crankcase by way of the breather mechanism. The expulsion gases pass, as indicated by the arrows, upwardly through the check valve and over an upper rim of the inner lower baffle 145 and then downwardly between the baffle and the downwardly depending baffle 143 and beneath a lower rim or edge of baffle 143 to then pass upwardly between the outer lower baffle 147 and the downwardly depending baffle 143, through a plurality of cap apertures, such as 149, 151 and 155 to the atmosphere. The inner cylindrical baffle 145, of course, includes a valve seat 153 of an annular configuration while the downwardly depending cylindrical portion 156 of the upper baffle portion restricts the valve disc to movement within the inner cylindrical baffle. An oil collecting tray of an annular configuration is formed by the bottom portion 157 which connects the inner and outer baffles from which, as noted earlier, oil drains back to the engine sump by way of drain holes, such as 137. It should also be noted that the location of the cap 119 remote from and substantially above the engine sump oil level, aids materially in the separation of oil from the escaping gases, as those gases pass along the oil fill tube extending from the engine crankcase to the oil filler opening.

Figure 7:
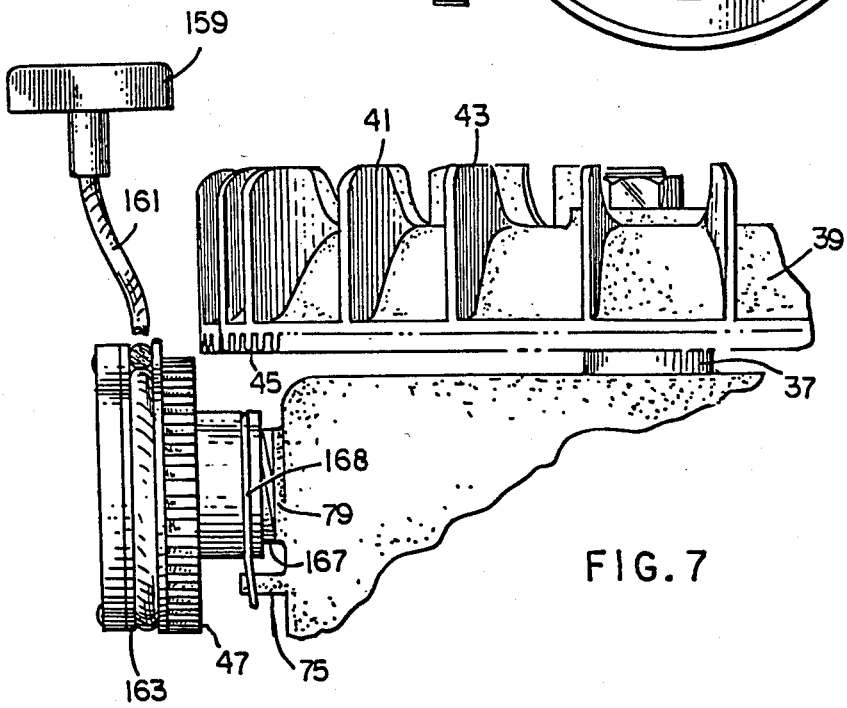
FIG. 7 illustrates a pull rope recoil starter disposed on the engine of FIG. 1 on the side opposite the cylinder head and spark plug.

Referring now to FIGS. 7 and 10, pulling the start handle 159 causes rope 161 to unwind from the drum 163, inducing rotation in that drum and helically threaded hub 167 about the axis of the recoil starter attaching bolt 165 and inducing a restorative force in the starter recoil spring. Gear 47 is attached to the hub 167 of the starter mechanism by a helical thread arrangement so that rotation of drum 163 causes gear 47 to move toward the left, as viewed in FIG. 10 and into engagement with the teeth 45 of the flywheel with continued rotation of hub 163 and of gear 47 providing the starting rotation of the flywheel. Spring clip 168 frictionally engages hub 167 and spans stud 75 to move the hub and starter gear between their axial limits. When the engine starts, gear 47 is disengaged and release of the handle 159 allows the mechanism to rewind for the next starting operation since the clock type coil spring urges the gear 47 back along the helical thread arrangement, and as tension of rope 161 is released, that rope is rewound about the drum 163. The further details of the starter mechanism may be as in conventionally employed rewind starters, as illustrated in U.S. Patent 3,375,813 for example, however, as noted earlier, substantial economies in the manufacture of the engine are realized by casting the recoil starter attachment boss 79 as well as the spring anchoring stud 75 and recoil starter rope guide 77 as integral portions of the engine block, and eliminating all support brackets. Another suitable recoil starter is illustrated in U.S. Patent 4,019,490.

From the foregoing, it is now apparent that a novel internal combustion engine having a unique block casting and valve train arrangement, as well as unique muffler and breather configurations, has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. A combination crankcase breather mechanism and oil fill cap for restricting an oil filler opening in an internal combustion engine while providing a flow path for expulsion of gases from the engine crankcase and limiting egress of oil from the engine through the flow path comprising:

a cap portion for engaging a complementary neck portion about the oil filler opening;

an upper baffle portion fastened to the cap portion and having a downwardly depending generally cylindrical baffle means;

a lower baffle portion fastened to the cap portion having an outer downwardly projecting generally cylindrical baffle means surrounding said upper baffle and including at its lowermost portion an inner upwardly extending cylindrical baffle means, said upwardly extending baffle means interleaved with said downwardly depending baffle means to form a tortuous path from the oil filler opening through the cap; and a check valve for restricting entrance of air into the engine crankcase by way of the breather mechanism while allowing the expulsion of gases from the engine crankcase by way of the breather mechanism, expulsion gases traversing said tortuous path by passing upwardly and over a rim of the inner upwardly extending lower baffle means, downwardly between the upwardly extending and downwardly depending baffle means, beneath a rim of the downwardly depending baffle means, and upwardly between the downwardly depending baffle means and the outer downwardly projecting baffle means to atmosphere.

2. The crankcase breather mechanism and oil fill cap of claim 1 wherein the upwardly extending baffle means includes inner and outer baffles which are connected by a generally annular bottom of the lower baffle portion, the annular bottom in conjunction with the inner and outer baffles forming an annular oil catching tray and including an oil drain for allowing oil accumulated in the tray to drain back into the engine crankcase.

3. The crankcase breather mechanism and oil fill cap of claim 1 wherein the check valve comprises a disc captive with a limited amount of free movement between the upper and lower baffle portions.

4. The crankcase breather mechanism and oil fill cap of claim 3 wherein the upwardly extending cylindrical baffle means includes an annular valve seat, the disc being captive within the upwardly extending cylindrical baffle means and movable therein between the valve seat and a downwardly depending disc movement limiting portion of the upper baffle portion.

5. A combination crankcase breather mechanism and oil fill cap for restricting an oil filler opening in an internal combustion engine while providing a flow path for expulsion of gases from the engine crankcase and limiting egress of oil from the engine through the flow path comprising:

a cap portion for engaging a complimentary portion of the oil filler opening;

an upper baffle portion fastened to the cap portion and having a downwardly depending baffle;

a lower baffle portion fastened to the cap portion having first and second baffles interleaved with the downwardly depending baffle to form a tortuous path from the oil filler opening through the cap, the first and second baffles being connected by a bottom of the lower baffle portion and forming in conjunction therewith an oil catching tray having an oil drain for allowing oil accumulated in the tray to drain back into the engine crankcase; and a check valve for restricting entrance of air into the engine crankcase by way of the breather mechanism while allowing the expulsion of gases from the engine crankcase by way of the breather mechanism, expulsion gases traversing said tortuous path by passing upwardly and over a rim of the first baffle, downwardly between the first and the downwardly depending baffles, beneath a rim of the downwardly depending baffle, and upwardly between the downwardly depending baffle and the second baffle to atmosphere.

6. The crankcase breather mechanism and oil fill cap of claim 5 wherein the check valve comprises a disc captive with a limited amount of free movement between the upper and lower baffle portions.

7. The crankcase breather mechanism and oil fill cap of claim 5 wherein the oil filler opening is located remote from the engine crankcase and substantially above the engine sump oil level to reduce the oil content of the gases reaching the oil filler opening, the combination further including an oil fill tube extending from the oil filler opening to the engine crankcase.

8. An internal combustion engine according to claim 5 further having a block casting including:

at least a portion of a muffler shell;

a boss for attaching a pull-rope recoil starter assembly;

an anchoring point for a spring of the recoil starter assembly;

a lug for a retaining guide for the rope of the recoil starter assembly; and a location for a spring to bias both intake and exhaust valves toward their closed positions, all integrally cast therewith.

* * * * *